US009359782B2

(12) United States Patent
Hui

(10) Patent No.: US 9,359,782 B2
(45) Date of Patent: Jun. 7, 2016

(54) AUTOMATED POOL CLEANING VEHICLE WITH SCRUBBING ELEMENTS

(71) Applicant: Wing-Kin Hui, Hong Kong (HK)

(72) Inventor: Wing-Kin Hui, Hong Kong (HK)

(73) Assignee: ZHIBAO POOLS COMPANY, Dongguan (CN)

( * ) Notice: Subject to any disclaimer, the term of this patent is extended or adjusted under 35 U.S.C. 154(b) by 0 days.

(21) Appl. No.: 13/717,601

(22) Filed: Dec. 17, 2012

(65) Prior Publication Data

US 2014/0165306 A1 Jun. 19, 2014

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654
USPC ..... 15/1.7
See application file for complete search history.

(56) References Cited

U.S. PATENT DOCUMENTS 6,815,918 B2 * 11/2004 Porat et al. ..... 318/568.12
2006/0059637 A1 * 3/2006 Fridman et al. ..... 15/1.7

* cited by examiner

*Primary Examiner* — Randall Chin
(74) *Attorney, Agent, or Firm* — Weiss & Moy, P.C.; Jeffrey D. Moy

(57) ABSTRACT

Disclosed herein is a submersible pool cleaning vehicle (PCV) having both cleaning and scrubbing structures. The PCV includes spaced wheels and wheel covers over the wheels include scrubbing elements. The PCV also includes a cleaning brush which dislodges particulates and facilitates the particulates being sucked into the intakes and then a filtering member. In one exemplary embodiment, the PCV includes wheel covers that have embedded scrubbing elements. In another exemplary embodiment, the scrubbing elements extend from the wheel covers and have a plurality of circular members.

15 Claims, 5 Drawing Sheets

AUTOMATED POOL CLEANING VEHICLE WITH SCRUBBING ELEMENTS

CROSS-REFERENCE TO RELATED APPLICATIONS

This application is related to application Ser. Nos. 13/531,594 and 12/939,079, filed by co-inventor, Wing-kin HUI, for POOL CLEANING VEHICLE HAVING SIDE VENTS AND DUCTS POOL CLEANING VEHICLE WITH ENDLESS LOOP TRACK, respectively and filed on Nov. 17 & 18, 2008, also respectively both of which have issued and are now U.S. Pat. Nos. 8,561,240 and 8,661,594 respectively and which are specifically incorporated herein and are to be used for all purposes consistent with incorporation by reference.

This application is also related to U.S. Pat. No. 8,225,446 B2 POOL CLEANING VEHICLE HAVING SIDE VENTS AND DUCTS and issued on Jul. 24, 2012 is specifically incorporated herein and are to be used for all purposes consistent with incorporation by reference.

And finally, this application is related to co-filed application Ser. No. 13/717,621, filed Dec. 17, 2012, which is abandoned.

FIELD OF THE INVENTION

This invention generally relates to the field of automated pool products. Particularly, this invention relates to an automated swimming pool cleaning vehicle (PCV) for facilitating thorough cleaning of the pool water and pool surfaces. More particularly, this invention relates to devices and cleaning structure used in cooperation with a PCV having a set of spaced apart wheels and providing structure for cleaning and scrubbing the pool surface.

BACKGROUND OF THE INVENTION

It is well accepted that submersible automated pool cleaning devices, such as self-propelled pool cleaning vehicles (PCV's) are essential to the proper maintenance of a pool, whether the pool be above or below ground. The typical PCV includes a housing and drive members. The drive members attach to the housing usually through connection to a chassis. Drive members include wheels, endless loop tracks and combinations of each. Additionally, vehicles have included two and four wheel drive vehicles in various combinations and variations. In the case of a belt or endless loop track. The track wraps around the drive and/or idler wheels or rollers.

It will be appreciated that a vehicle may also have some combination of wheels and/or rollers and the vehicle may also be a two or four-wheel drive vehicle. The endless loop track may be fitted over any combination of two or four wheel drive vehicles. Such tracks have been found to be an effective means for moving the vehicle around the surface of the pool while the vehicle is submerged.

Of course, the primary purpose for all PCV's is to clean the pool and pool water. In order to properly maintain clean pool water, the water itself as well as the pool surfaces must be cleaned and kept clean. It is imperative to keep the pool surfaces free from the buildup of dirt and debris. Once dirt and/or debris is allowed to settle in on the pool surface, algae forms. A large enough build-up of such algae can cause the pool pH to become unbalanced and the pool water unstable.

Sometimes drastic efforts caused by "dirty" water result in the entire contents of the pool being drained and starting again. As can be appreciated this is an expensive and time consuming process. Additionally, without thorough cleaning and maintenance, the situation will simply be repeated. There is no guarantee, without proper maintenance methods that the water will not simply revert to the same "dirty" condition.

Of special concern in this regard, is the fact that embedded particles can be particular concern. As noted by others, these embedded particulates can cause fatal consequences in term of "dirty water". It can lead to the emptying of the pool of all its water for dry cleaning. Clearly, such a condition is to be avoided if at all possible.

Clearly, there is a strong industry-wide need to prevent the buildup of particulates in the pool water. There is even a stronger need to prevent the embedding of such particulates in the surface of the pool. Cleaning each and every square millimeter of the pool's surface manually is simply not a practical solution. Therefore, Applicant has developed a structure for using the automated pool cleaning vehicle to dislodge even embedded particulates in the surface of the pool. Additionally, the cleaning structure, in accordance with the invention herein, facilitates the PCV in thoroughly cleaning the dirt and debris dislodged from the pool's surface. Thus, the structure in accordance with the invention herein, not only serves the short term goal of keeping the water clean and free from dirt and debris, but also is helpful in accomplishing the long term goal of preventing the buildup of such particulates on and in the surface of the pool by removing the same from the pool water.

What is needed is cleaning structure for a submersible automated pool cleaning vehicle (PCV), which is adapted to clean the pool surface by dislodging dirt and debris from the surface of the pool and further to dislodge even embedded dirt and debris from the surface of the pool using the automated motion of the PCV.

SUMMARY OF THE INVENTION

The cleaning structure for a Pool Cleaning Vehicles (PCV), in accordance with the present invention defines a sanitizing structure. Such structure is limited to a PCV having spaced apart free-spinning and drive wheels and not drive tracks, which was the subject of an earlier patent specification by the one of the inventors herein. The sanitizing structure herein is a combination of the cleaning member on the PCV chassis, the suction created by the PCV for absorbing dirt and debris through the PCV intakes and the scrubbing elements associated with the wheels. The scrubbing members include elements extending from the wheels. In an exemplary embodiment, the wheels include wheel covers substantially covering the wheels. The scrubbing elements extend from the wheel covers. The cleaning member is a rotating brush attached to the bottom of the PCV housing and includes bristles for dislodging dirt and debris as the PCV movers along the pool surface. As the PCV with the sanitizing structure, in accordance with the invention, moves about the pool surface, the wheels with the scrubbing elements and the bristles on the housing dislodge dirt and debris. Thus, the dirt and debris dislodged by the cleaning and scrubbing members are then sucked up by the PCV through housing intakes, cleaning and sanitizing the pool water.

It is an object of this invention is to provide cleaning structure attachable to the PCV through the chassis of the drive wheels and housing for sanitizing swimming pool water.

It is an additional object of this invention to provide such sanitizing structure, which is attachable to a PCV and thereby uses automated means to dislodge dirt and debris from the pool surface.

It is an additional object of this invention to provide such sanitizing structure, which is attachable to a PCV and thereby uses automated means to dislodge dirt and debris embedded in the pool surface.

In accordance with the objects set forth above and those that will be described hereinafter, the PCV in accordance with this invention including spaced apart drive wheels and the sanitizing structure being attachable to the chassis and the housing, comprises:

- a housing having an exterior and an interior and including intakes and a vacuum member for drawing water into the housing through the intakes, the housing including a filter member for filtering water drawn into the housing through the intakes and an outlet for expelling the filtered water back into the pool;
- a chassis attached to the housing and being generally within the interior;
- drive means attached to the chassis for propelling the PCV throughout the surface of the pool, the drive means including spaced apart wheels connected to the axles for receiving power from the drive means;
- a cleaning member for dislodging particulates;
- scrubbing members extending from at least some of the wheels, the portion extending from the wheels defining scrubbing elements;

whereby, as the PCV moves around the pool surface the bristles contact the surface of the pool and dislodge dirt and debris and whereby the vacuum member absorb the dislodged dirt and debris to facilitate sanitizing the pool water.

In another exemplary embodiment, the PCV, in accordance with this invention, the wheels have scrubbing elements and include wheel covers, covering at least a substantial portion of the wheels and the scrubbing elements are embedded in the wheel covers.

In an exemplary embodiment, all of the spaced apart wheels include scrubbing elements and the wheel covers cover at least a substantial portion of the wheels and the scrubbing elements extend from the wheel covers.

In another exemplary embodiment, the wheels include a tire made of a soft rubber compound and the wheel covers are made from elastomer.

In another exemplary embodiment, the wheel covers include a scrubbing element insert made from a material specifically designed for scrubbing pool surfaces.

In another exemplary embodiment, the wheel covers include an extended scrubbing element. The extended scrubbing elements include a plurality of circular elements. The circular elements include a plurality of circular elements, which are co-axial and overlapping. The circular scrubbing elements are made from a material specifically designed to loosen stains and dirt and debris from pool surfaces with rotating action.

It is an advantage of the instant invention to provide a sanitizing PCV, which cleans and sanitizes pool water in an automated fashion by dislodging particulates from the surface of the pool.

It is also an advantage of the invention to provide detachable sanitizing elements to a pool cleaning vehicle, which can be replaced upon becoming worn.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
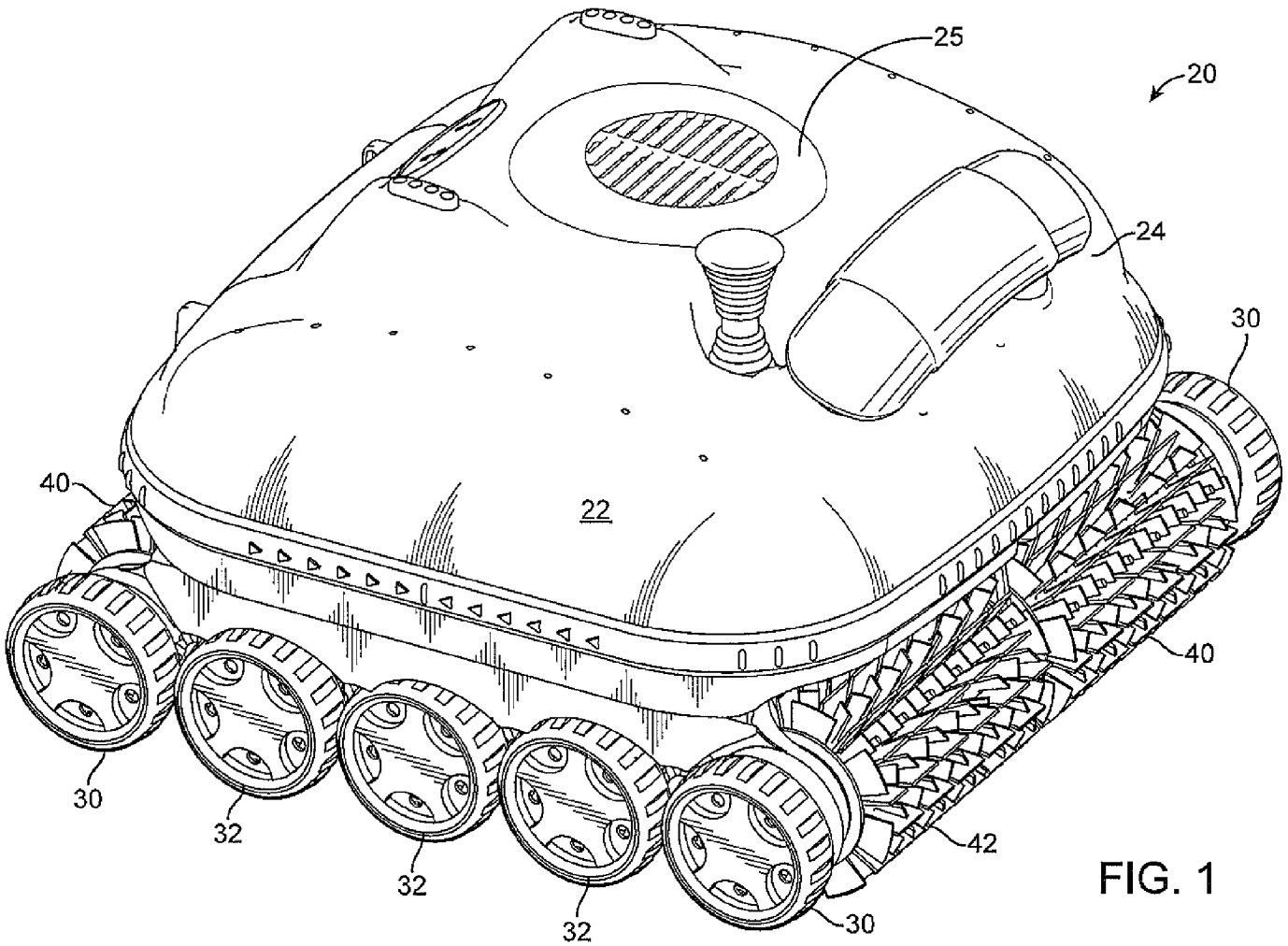
FIG. 1 is a perspective view of a pool cleaning vehicle having the sanitizing structure in accordance with this invention.

With respect to FIG. 1 there is shown an exemplary embodiment of the submersible pool cleaning vehicle (PCV) having the cleaning structure in accordance with this invention generally denoted by the numeral 20.

The PCV 20 includes a housing 22 having an exterior 24 and an interior (not shown). Within the interior of the housing is a motor for creating a vacuum effect. The housing includes conduit terminating at the housing intakes for drawing water into a filter system and an outlet 25 for expelling filtered water back into the pool. Such features are well known and are described in the art. For example, U.S. Pat. No. 7,867,389 B2 and U.S. application Ser. No. 12/100,414 now U.S. Pat. No. 8,627,532 show further details of the above functions, the entire specifications of which are specifically incorporated herein for all purposes.

The PCV 20 includes a chassis (not shown) generally within the interior of the housing 22. The PCV includes an electrical motor (not shown) which power drive wheels 30. The PCV includes additional free-spinning wheels 32. The free-spinning wheels 32 are also mounted on the chassis.

The wheels, whether drive wheels 30 or free spinning wheels 32 are spaced apart from one another. This is in contrast to earlier described inventions in this art where the PCV included a drive track instead of spaced apart wheels. For example, such inventive aspects of cleaning a pool surface under water are described in a related application, namely U.S. application Ser. No. 12/939,079, now U.S. Pat. No. 8,661,594 the entire specification of which is specifically incorporated herein for all purposes. When the drive motor is activated, the PCV is propelled by supplying rotational power to the drive wheels 30.

The PCV also includes a cleaning member 40. The cleaning member 40 is mounted on an axle between drive wheels 30 as shown clearly in FIG. 1. In the exemplary embodiment shown, each pair of drive wheels 30, front and rear, includes a brush roller 42 defining a cleaning member 40. Under power, the drive wheels 30 turn the roller 42 with sufficient torque to cause the brush roller 42 to dislodge particulates and dirt and debris. The brush roller 42 can be easily removed and replaced as needed.

An intake (not shown) is located in close proximity to the roller 42 for sucking up such loosened matter. Again, this is well understood in the art and the references specifically incorporated above and below provide sufficient basis for understanding these principles.

Figure 2:
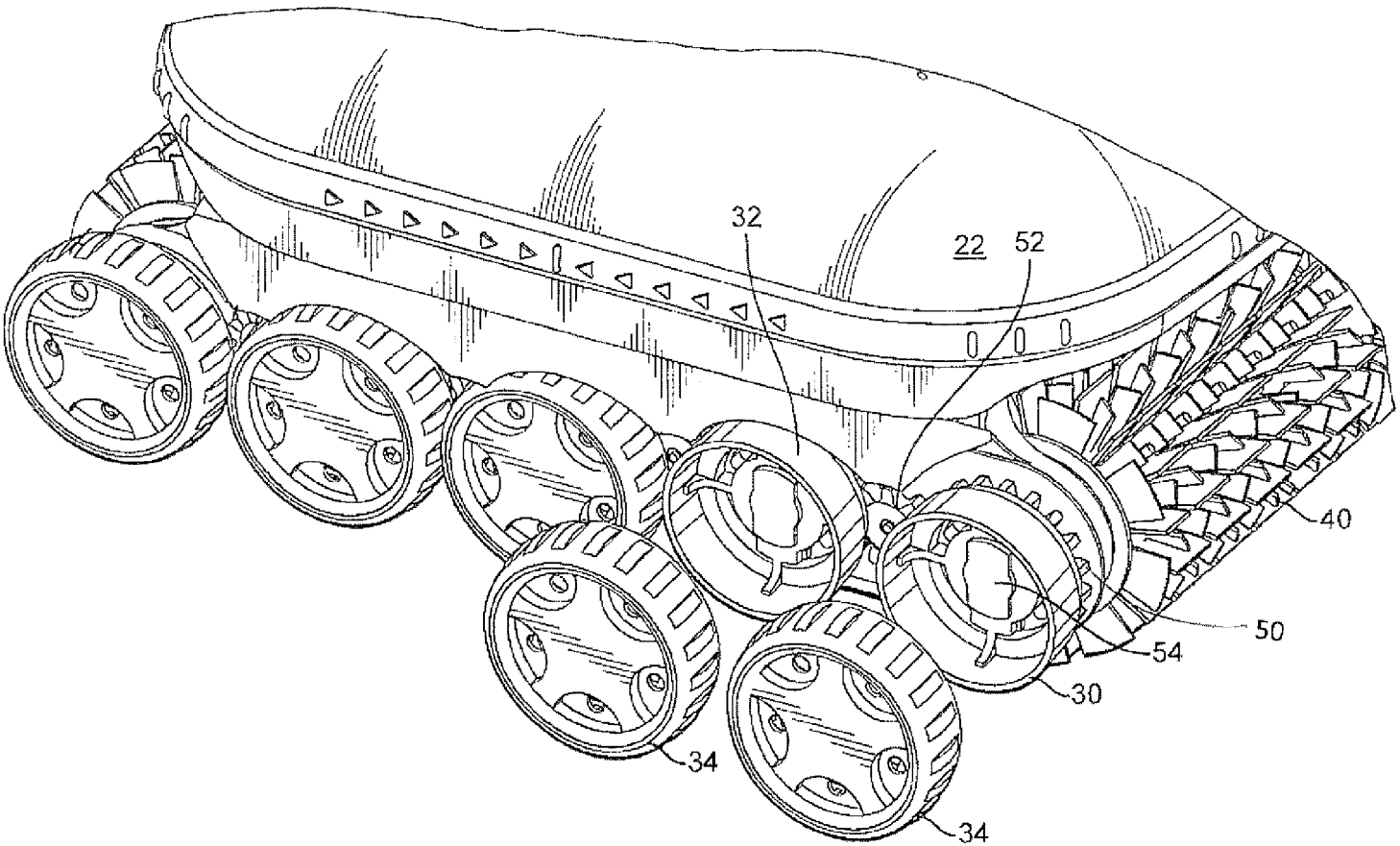
FIG. 2 is side perspective view of an exemplary embodiment of the PCV in accordance with this invention illustrating wheel covers in the applied and unapplied states having embedded scrubbing elements in the wheel covers.

With particular reference to FIG. 2 there is shown another illustration of the PCV 20 in accordance with this invention. Particularly illustrated are the wheels 30 and 32 having wheel covers 34 removed from two of the wheels 30 and 32. As shown, the wheel covers 34 fit over either the drive wheel 30 or free-spinning wheel 32 without modification. In other words, the wheel cover 34 is the same for the drive wheel 30 as it is for free-spinning wheel 32.

The wheel cover 34 is made from an elastic material which fits over the wheel and covers the outer diameter dimension of the wheel. In this manner, the wheel cover 34 covers substantially the wheel. The fit can be made tight or sloppy. In some instances, a sloppy fit serves the purpose of dislodging particulates, dirt and/or debris better than a tight fit. At other times, the reverse is true and an exemplary embodiment with either a tight fit or a sloppy fit are both within the spirit and scope of the present invention. In the exemplary embodiment illustrated in FIGS. 1 & 2, the wheel cover 34 is tightly stretched over the wheel forming a snug fit.

As also illustrated in FIG. 2, the drive wheel 30 includes gearing 50 for compatible mating of the drive wheel 30 with the chassis gearing 52. A locking member 54, locks the wheel to the chassis. In applying the wheel cover 34 to the drive wheel 30, the cover fits so that it does not interfere with the ability of the drive wheel 30 to be driven by the PCV motor.

The wheel cover 34 is easily removed from either drive or free-spinning wheel by again stretching the elastic wheel 34 over the wheel and completing the removal process. Thus, should the wheel cover 34 become worn or a different type of wheel cover 34 for a particular pool surface is desired, such can easily be facilitated in this manner.

The flexibility of selecting a wheel cover to match the kind of cleaning function desired enables the PCV in accordance with this invention to maximize the cleaning such that the pool can, in fact, be sanitized. Additionally advantageous, long standing stains found in certain pool surfaces can be removed by automatic means, without having to resort to manual brushes and the like.

Figure 3:
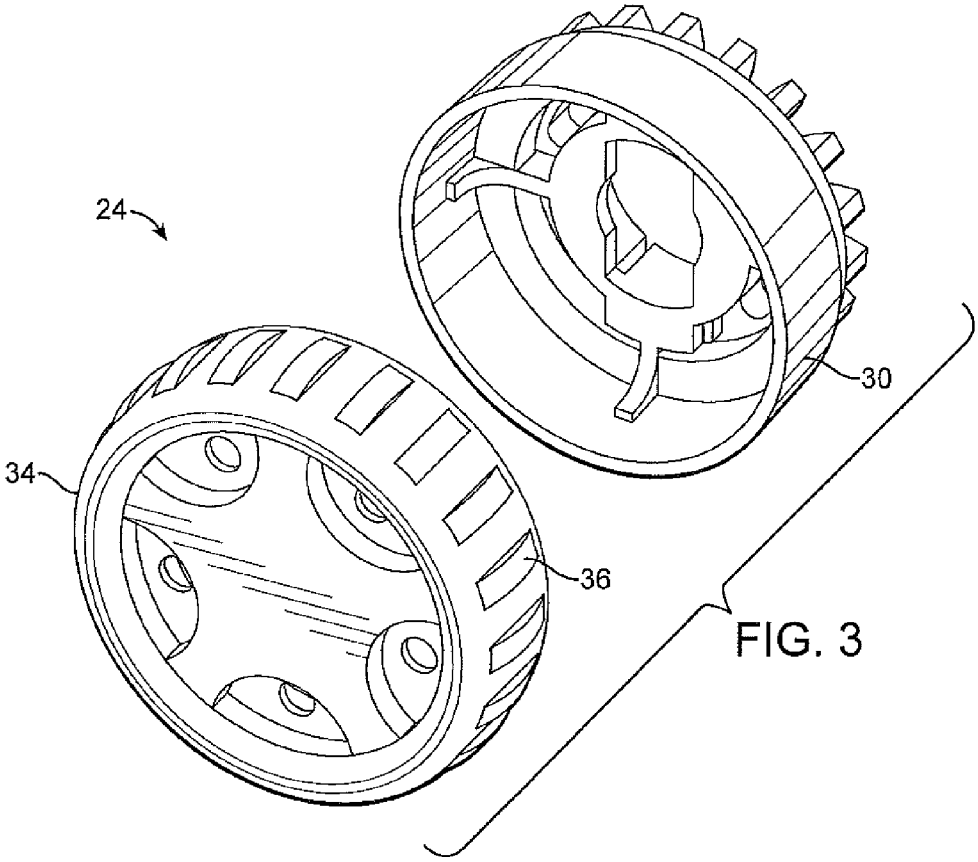
FIG. 3 illustrates, in perspective, the wheel cover being applied to and/or separated from the wheel of the PCV.
Figure 4:
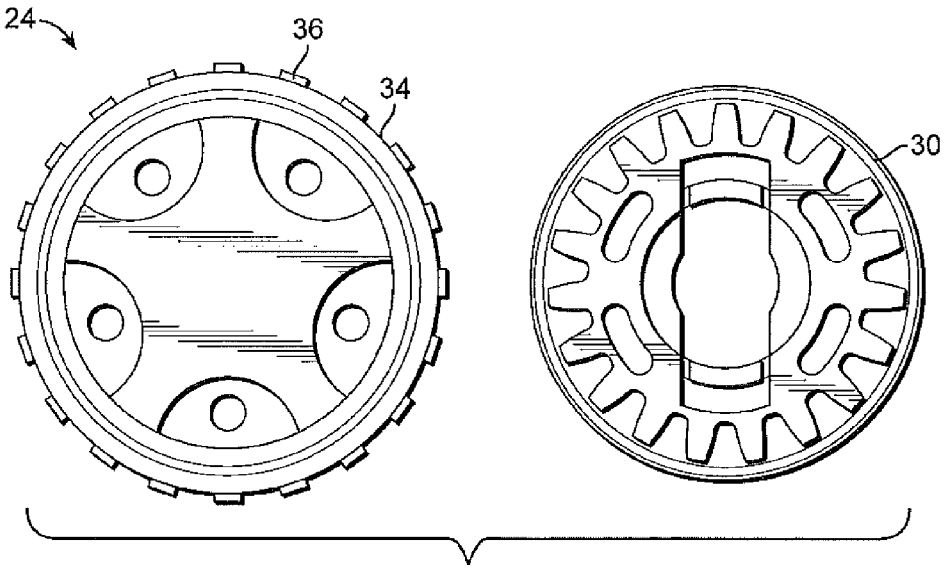
FIG. 4 is a side by side illustration of the wheel cover separated from the wheel.

With respect to FIGS. 3 and 4 are detailed views that illustrate the construction of the drive wheel 30 and wheel cover 34. The wheel cover 34 includes scrubbing elements 36. The scrubbing elements 36 are embedded in the wheel cover 34. The scrubbing elements 36 extend from the wheel cover 34 as most clearly illustrated in FIG. 4.

In an exemplary embodiment, the wheel covers 34 are made from elastomer. The degree of hardness of the elastomer depends upon the pool surface. On some pool surfaces a harder degree of elastomer is more desirable than on others. By providing a variety of different wheel covers 34, which are easily changeable, the user can custom make his PCV for his own particular pool surface.

Likewise, the scrubbing elements 36 are similarly customizable. For example, a wheel cover 34 may have one type of hardness and the scrubbing element can be imbedded with a specific material that would be best suited for that surface. In this way, a variety of wheel covers and scrubbing elements can be offered to the user to best suit the needs of a particular pool surface.

The drive wheels 30, as well as the free spinning wheels 32, may include tires (not shown) where the tire is made from a soft rubber compound and the wheel cover is made from an elastomer. In the exemplary embodiment of FIGS. 3 & 4, the wheel cover 34 defines the tire and can be made from various compounds, both natural and synthetic that would satisfy the requirements of moving the PCV and cleaning the underwater pool surface.

Figure 5:
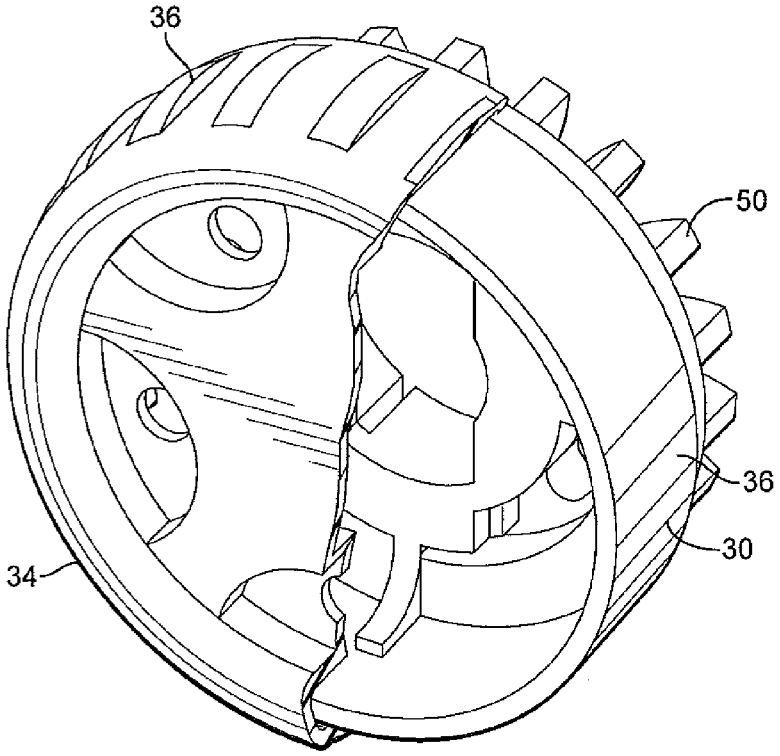
FIG. 5 is a partial sectional view of the wheel cover being applied to the wheel of the PCV in accordance with this invention.

With particular reference to FIG. 5, there is shown the partial sectional illustration of the wheel cover 34 having scrubbing elements 36 attached over the wheel 30. As noted above the wheel cover 34 is made from elastic material and is stretched over the wheel 30. Also illustrated is that the wheel cover 34 does not interfere with the gearing 50.

Figure 7:
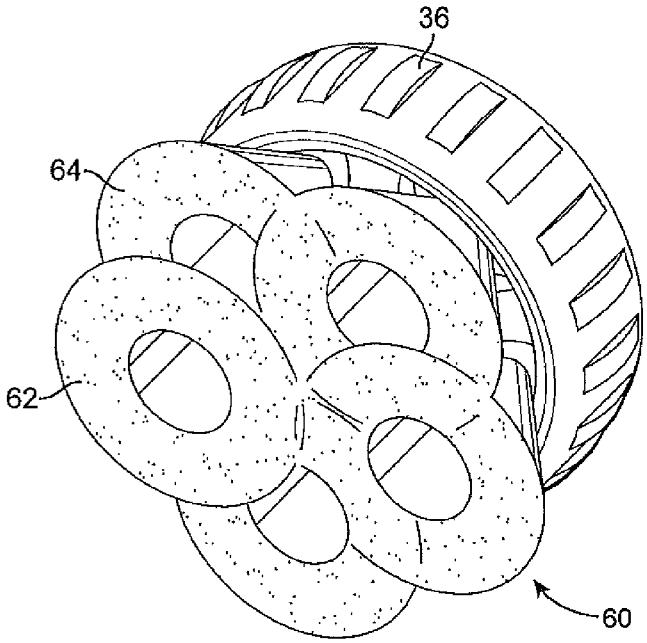
FIG. 7 is a perspective view of alternative scrubbing elements in accordance with this invention attached to the wheel cover of the wheel of the PCV in accordance with this invention.
Figure 6:
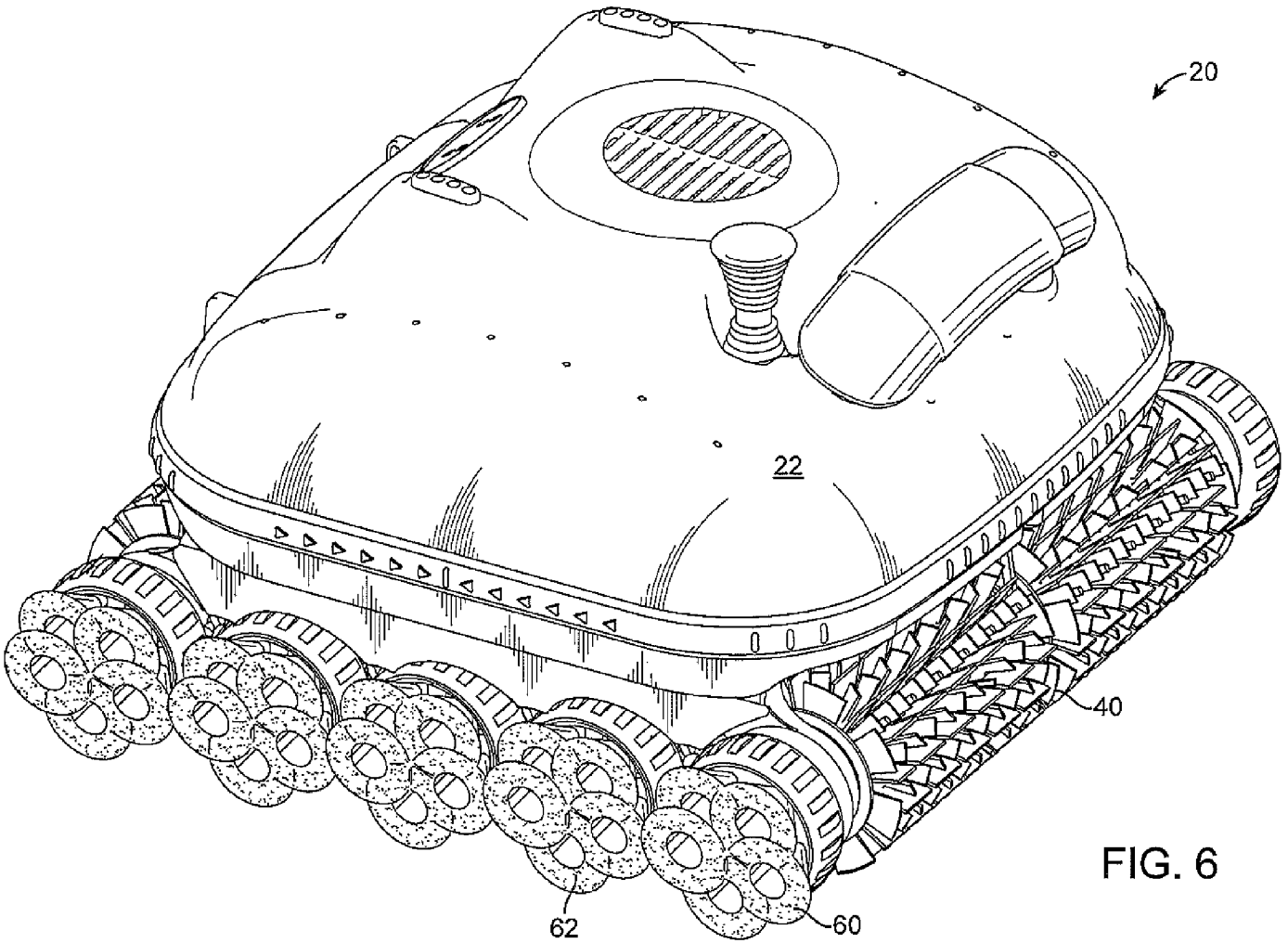
FIG. 6 is a perspective view of another exemplary embodiment of the pool cleaning vehicle having additional sanitizing structure in accordance with this invention.

With respect to FIGS. 6 & 7, there is shown another exemplary embodiment of the scrubbing elements in accordance with the invention, generally designated by the numeral 60. In this embodiment, the scrubbing elements 60 extend from the wheel cover 34. The scrubbing elements 60 include a plurality of individual members 62.

The members 62 define circular scrubbing elements having an outer surface 64. The outer surface 64 is made from a material designed to dislodge dirt and remove stain from a pool surface as the PCV collides with the surface during normal operation. For example, the material such as a vinyl or rubber sponge having a rough, but non-abrasive surface is suited for such function.

The circular members 62 as illustrated are co-axial and overlapping. In the exemplary embodiment shown, there are 5 such members. In other exemplary embodiments 2 members or more than 5 would also be within the spirit and scope of the invention.

It will be appreciated by those skilled in the art that as the wheels turn, the scrubbing elements 60 rotate. When contact between the scrubbing element 60 and the underwater pool surface, for example a pool wall, is made, the rotating action continues. As the scrubbing elements rotate against dirt and stain, such are removed from the pool surface so contacted. The dislodged material is sucked by the vacuum created by the motor through the intakes. The water is filtered and then returned to the pool through the outlet 25. In this manner, the pool water is not simply cleaned, but sanitized.

Various other types of scrubbing elements which extend from the wheel cover are also within the spirit and scope of the invention. For example, the scrubbing element 60 may define an irregular shape or a rectangle or square configuration, all are within the spirit and scope of the instant invention. Additionally, the number of members which form the scrubbing element 60 may also vary within the spirit and scope of the invention.

While the foregoing detailed description has described several embodiments of the cleaning structure in accordance with this invention, it is to be understood that the above description is illustrative only and not limiting of the disclosed invention. Particularly, there are varieties of different combinations of embedded and extended scrubbing elements that can be used successfully with the PCV in accordance with this invention. Each such combination, although not specifically recited and described above is within the spirit and scope of this invention.

It also will be appreciated that there are various modifications to the size and type of the spaced apart wheels within the spirit and scope of the invention herein and that of particular interest is the ability of the PCV to dislodge dirt and debris using the side of the wheels, whether drive or free-spinning to accomplish this function during PCV operation. It also will be appreciated that PCV in accordance with the invention herein includes a drive structure which is propelled by water flowing through output jets located on the housing. In this embodiment, no motor is required to propel the PCV. Thus, the invention is to be limited only by the claims as set forth below.

What is claimed is:

1. An automated, fully submersible pool cleaning vehicle (PCV) for sanitizing water in a swimming pool, the PCV, comprising:

a housing having an exterior and an interior and including intakes and a vacuum member for drawing water into the housing through the intakes, the housing including a filter member for filtering water drawn into the housing through the intakes and an outlet for expelling the filtered water back into the pool;

a chassis attached to the housing and being generally within the interior;

drive means attached to the chassis for propelling the PCV throughout the surface of the pool, the drive means including spaced apart wheels and axles for the wheels, the wheels connected to the axles for receiving power from the drive means;

a cleaning member attached to the housing;

a portion of scrubbing members extending from at least some of the wheels, the portion extending from the wheels defining scrubbing elements;

whereby, as the PCV moves around the pool surface the scrubbing elements contact the surface of the pool and dislodge dirt and debris and whereby the vacuum member absorbs the dislodged dirt and debris to facilitate sanitizing the pool water.

2. The PCV as set forth in claim 1, wherein the wheels having scrubbing elements include wheel covers covering at least a substantial portion of the wheels and the scrubbing elements are embedded in the wheel covers.

3. The PCV as set forth in claim 2, wherein all of the spaced apart wheels have scrubbing elements and include wheel covers covering at least a substantial portion of the wheels and the scrubbing elements extend from the wheel covers.

4. The PCV as set forth in claim 2, wherein the wheels include a tire made of a soft rubber compound and wherein the wheel covers are made from elastomer.

5. The PCV as set forth in claim 4, wherein the wheel covers include a scrubbing element insert made from a material specifically designed for scrubbing pool surfaces.

6. The PCV as set forth in claim 2, wherein the wheel covers are easily detached from the wheels and easily re-attached to the wheels.

7. The PCV as set forth in claim 2, wherein the cleaning member defines a rotating brush and the housing has a bottom and the rotating brush is connected to the bottom of the housing adjacent the intakes.

8. The PCV as set forth in claim 7, wherein the brush is easily detached from the wheels and easily re-attached to the chassis.

9. The PCV as set forth in claim 2, wherein the wheel covers include scrubbing elements extended from the wheel covers and away from the housing.

10. The PCV as set forth in claim 9, wherein the extended scrubbing elements include a plurality of circular elements.

11. The PCV as set forth in claim 10, the plurality of circular elements are co-axial and overlapping.

12. The PCV as set forth in claim 11, wherein the extended scrubbing elements are made from a material specifically designed to loosen stains and dirt and debris from pool surfaces with rotating action.

13. The PCV as set forth in claim 1, wherein the wheels are connected to the chassis through gears.

14. The PCV as set forth in claim 1, wherein the wheels are connected to the chassis through a set of gears.

15. The PCV as set forth in claim 1, wherein the wheels are easily detached from the chassis and easily re-attached to the chassis.

* * * * *